US006505360B2

(12) United States Patent
Guillot

(10) Patent No.: US 6,505,360 B2
(45) Date of Patent: Jan. 14, 2003

(54) CRIB WITH DROP SIDE, AND GUIDING AND LOCKING MECHANISM THEREFOR

(75) Inventor: Edmond P. Guillot, Conover, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 110 days.

(21) Appl. No.: 09/827,830

(22) Filed: Apr. 6, 2001

(65) Prior Publication Data

US 2002/0144344 A1 Oct. 10, 2002

(51) Int. Cl.[7] ..... A47D 7/02
(52) U.S. Cl. ..... 5/100; 5/93
(58) Field of Search ..... 292/32, 33, 37, 292/42; 49/449, 404, 453, 209; 5/100, 93, 424, 428

(56) References Cited

U.S. PATENT DOCUMENTS

| | | | |
|---|---|---|---|
| 1,179,684 | A | 4/1916 | Vallone |
| 1,695,571 | A | 12/1928 | Baxter |
| 2,369,834 | A | 2/1945 | Lundin |
| 2,383,167 | A | 8/1945 | Shaw |
| 2,429,421 | A | 10/1947 | Merrett et al. |
| 2,473,914 | A | 6/1949 | Shaw |
| 2,630,582 | A | 3/1953 | Bukolt |
| 2,845,634 | A | 8/1958 | Landry |
| 3,002,199 | A | 10/1961 | Galloway |
| 3,397,001 | A | 8/1968 | Friedman |
| 3,649,973 | A | 3/1972 | Benoit et al. |
| 3,896,514 | A | 7/1975 | Feldstein |
| 3,934,282 | A | 1/1976 | Bryant |
| 3,935,603 | A | 2/1976 | Bryant |
| 4,204,286 | A | 5/1980 | Stiles et al. |
| 4,356,593 | A | 11/1982 | Heininger et al. |
| 4,413,365 | A | 11/1983 | Flye et al. |
| 4,535,493 | A | 8/1985 | Guillot |
| 4,724,556 | A | 2/1988 | Burnham |
| 4,951,330 | A | 8/1990 | Burnham |
| 4,982,463 | A | 1/1991 | Burnham |
| 5,084,923 | A | 2/1992 | Guillot |
| 5,165,124 | A | 11/1992 | Li |
| 5,201,085 | A | 4/1993 | Shamie |
| 5,261,737 | A | 11/1993 | Faust et al. |
| 5,327,594 | A | 7/1994 | Sun |
| 5,617,593 | A | 4/1997 | Pham |

FOREIGN PATENT DOCUMENTS

| | | |
|---|---|---|
| AU | 107184 | 8/1938 |

*Primary Examiner*—Anthony Knight
*Assistant Examiner*—Fredrick Conley
(74) *Attorney, Agent, or Firm*—Alston & Bird LLP

(57) ABSTRACT

A crib having a drop side that vertically slides between lowered and raised positions includes a guiding and locking mechanism for the drop side, comprising a pair of lower guides and a pair of upper guides affixed to the crib's corner posts, and a plurality of slides affixed to the drop side and slidably engaging the guides. Each guide comprises a plate-shaped guide member and each slide defines a channel in which the guide member is slidably received. One edge of each lower guide member has a recess formed therein, and a resilient locking member integrally formed with the guide is positioned opposite the recess and urges the slide into the recess to lock the drop side in the raised position. Each lower guide also includes a second, lower recess into which the slides are urged by a second, lower resilient locking member for locking the drop side in a lowered position.

31 Claims, 3 Drawing Sheets

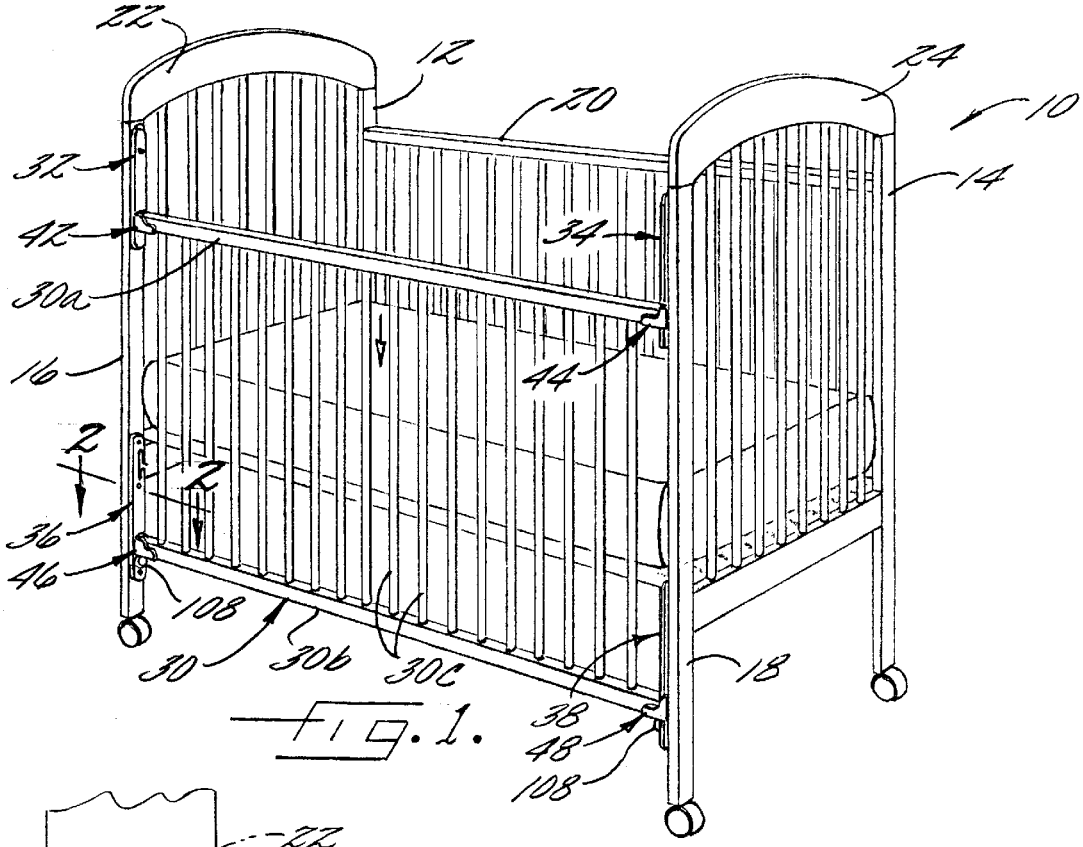
FIG. 1.
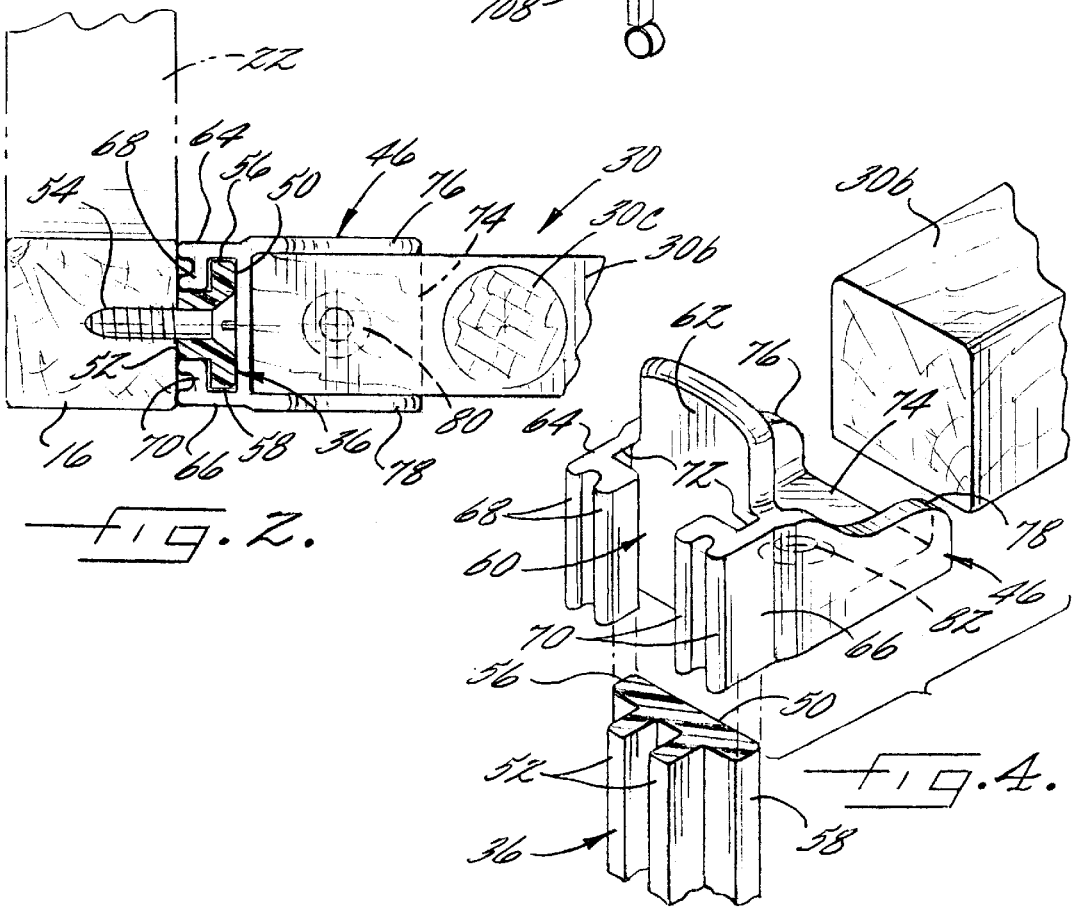
FIG. 2.
FIG. 4.

30
30a
30b
30c
42
44
46
48
54
80
32
34
36
108

90
92
94
96
98
99
100
102
104
106
50
52
56
58

110
111
112
114
116
5
6

CRIB WITH DROP SIDE, AND GUIDING AND LOCKING MECHANISM THEREFOR

FIELD OF THE INVENTION

The present invention relates to a crib having a vertically slidable drop side, and to a guiding and locking mechanism for guiding the vertical movement of the drop side and for locking the gate in a selected position.

BACKGROUND OF THE INVENTION

Baby cribs typically include a drop side that can be dropped into a lowered position to facilitate placing the baby in or removing the baby from the crib, and then can be lifted to a raised position and locked in the raised position. Many different guiding and locking arrangements have been developed for guiding the vertical sliding motion of a drop side and for locking the gate in a raised position. In some prior guiding and locking arrangements, two hands have been required for releasing the locking mechanism so that the gate can be lowered. For instance, some locking mechanisms have employed a pair of spring-loaded pins fixed to the upper bar of the drop side and engageable with holes or recesses in a fixed structure of the crib. In this type of mechanism, both pins must be simultaneously disengaged from the holes or recesses in order to drop the gate, and hence two hands are required for lowering the gate. This is inconvenient when placing a baby in the crib, since one's hands are occupied with holding the baby.

To alleviate the problem noted above, locking mechanisms have been developed that can be released by lifting the drop side upward, which can be done with one hand. For example, Australian Patent No. 107,184 discloses a mechanism for a drop side of a cot employing vertically extending guide bars affixed to the corner posts of the cot adjacent opposite ends of the drop side, and a pair of upper loops and a pair of lower loops fixed to the opposite upper and lower ends of the drop side. The loops slidably receive the guide bars. The upper end of each guide bar has a locking slot formed in its front edge to co-act with the upper loop that slides along the guide bar. Each upper loop includes an internal spring that constantly urges the loop in a direction from the front edge to the rear edge of the guide bar, such that when the drop side is raised to an upper position in which the upper loops are aligned with the locking slots, the springs force the loops into the locking slots so that the drop side is locked in the upper position. The drop side is released by lifting and pulling the drop side outwardly to disengage the upper loops from the locking slots, thus allowing the drop side to be lowered. The mechanism of Australian Patent No. 107,184 does not lock the drop side in the lowered position. The spring internal to each upper loop comprises a leaf spring having one portion that passes around and is clenched onto the upper loop and another portion that bears against the rear edge of the associated guide bar. Thus, assembly is required to incorporate the springs in the upper loops.

A number of patents, including U.S. Pat. Nos. 2,369,834 and 1,695,571, disclose crib drop side locking arrangements in which the drop side includes pins or similar projections at the opposite upper or lower ends of the drop side that extend toward the adjacent corner posts and slide within grooves or guide tracks formed in guide members affixed to the corner posts, and wherein an upper end of each guide track includes a downwardly extending hook-shaped portion that terminates at a stop or abutment at the lower end of the hook-shaped portion. The drop side is raised until the projections reach the hook-shaped portions, and is then lowered slightly so that the projections slide down the hook-shaped portions and come to rest on the abutments, thus retaining the drop side in a raised position. In these patents, there are no springs for urging cooperative locking members into engagement with each other; instead, the projections are urged into the hook-shaped portions of the guide tracks by the user urging the drop side in the direction in which the hook-shaped portion extends away from the main linear part of the guide tracks. In this sense, the drop side locking mechanisms of these patents do not automatically engage to lock the drop side in a raised position, since they require the user to produce a particular movement of the drop side inwardly or outwardly to ensure that the projections engage the hook-shaped portions of the guide tracks. Furthermore, these patents do not disclose any mechanism for locking the drop side in a lowered position.

Some prior drop side locking mechanisms, such as shown in U.S. Pat. No. 3,934,282, have employed an elongate trip wire or rod fixed along the lower rail of the drop side such that the rod can rotate about its longitudinal axis. A central portion of the rod is offset to form an actuator, and opposite ends of the rod are formed as offset cranks. In one rotational position of the rod, and when the drop side is raised to an upper position, the cranks engage stop members attached to the corner posts of the crib at each end of the drop side. The drop side is lowered by slightly raising the drop side and pressing the actuator of the rod to cause the rod to rotate such that the cranks disengage the stop members. A drawback of this arrangement is that the actuator is located at the lower rail of the drop side, and thus is in an inconvenient location for actuation by a user's hand, and, although the user could use a foot to press the actuator; at least one hand would still be required to slightly raise the drop side. Thus, this arrangement would be awkward to use. Additionally, the '282 patent does not disclose any mechanism for locking the drop side in a lowered position.

SUMMARY OF THE INVENTION

The present invention addresses the above needs by providing a crib having a drop side and a guiding and locking mechanism therefor, in which the drop side is locked in a raised position by sliding the drop side up until the locking mechanism automatically engages, the drop side is lowered by slightly lifting and pressing inwardly on the drop side to release the locking mechanism, and the drop side is locked in a lowered position by an additional locking mechanism. In accordance with a preferred embodiment of the invention, a crib comprises a rear panel connected between a pair of vertical rear corner posts, a front panel comprising a drop side connected between a pair of vertical front corner posts, and a pair of end panels connected between the front and rear corner posts to form a rectangular structure. The crib also includes at least one guide affixed to each of the front corner posts adjacent opposite ends of the drop side, each guide defining a vertically extending guide track. A slide is affixed to each of the opposite ends of the drop side and is in sliding engagement with the guide track of the adjacent guide, whereby the drop side is vertically slidable along the guides between raised and lowered positions. The guide track of each of the guides is formed by a pair of vertically extending, spaced guide surfaces respectively facing generally toward and away from the rear panel, one of the guide surfaces having an upper recess that is recessed in a horizontal direction near an upper end of the guide track, and the guide defining a stop surface facing generally upwardly and located adjacent a lower end of the upper recess. Each guide further comprises a resilient upper locking member affixed to the guide opposite the upper recess and arranged to contact and urge the slide into the upper recess when the drop side is slid upward to the raised position such that drop side is prevented by the stop surfaces from sliding back down to the lowered position. The slides are disengageable from the upper recesses by urging the drop side in a direction generally normal thereto so as to urge the slides against the upper locking members to deflect the upper locking members until the slides clear the stop surfaces such that the drop side can be dropped to the lowered position.

In a preferred embodiment, each front corner post has an upper guide and a lower guide affixed thereto adjacent upper and lower rails of the drop side, and there is an upper slide and a lower slide affixed to each end of the drop side for slidably engaging the upper and lower guides. The lower guides preferably have the recesses for locking the drop side in the raised position, but alternatively the upper guides could have the recesses rather than the lower guides. Of course, it is also possible to employ a single guide on each front corner post, extending from adjacent the lower rail to adjacent the upper rail of the drop side, and to provide the recess in the guide in either an upper or a lower region of the guide for interacting with either the upper slide or the lower slide, respectively.

Preferably, however, separate upper and lower guides are employed and the recesses are in the lower guides. Each lower guide preferably includes a retaining portion that projects upward from adjacent the lower end of the upper recess and forms a slot between the retaining portion and an opposing portion of the lower guide such that the lower slides cannot be disengaged from the upper recesses until the lower slides are lifted over the retaining portions. Accordingly, the drop side must be both lifted and urged in the direction generally normal to the drop side in order to be dropped to the lowered position.

In a preferred embodiment, each lower guide and corresponding upper locking member are integrally formed together as a one-piece structure. For example, the guide can be molded of plastic such that the upper locking member is integrally molded with the guide. Preferably, each lower guide further comprises a lower recess in one of the guide surfaces proximate a lower end of the lower guide, and a resilient lower locking member affixed to the lower guide for urging the lower slide into the lower recess when the drop side is dropped to the lowered position. Each lower guide defines a downward-facing stop surface adjacent an upper end of the lower recess for preventing the lower slide from being slid back up along the guide track as long as the lower slide is in the lower recess, whereby the drop side is locked in the lowered position. The guide and the upper and lower locking members advantageously are integrally formed together.

The lower locking member of each lower guide preferably is structured and arranged to apply a continuous biasing force on the corresponding lower slide when disposed in the lower recess. This arrangement can substantially reduce rattling of the lower slides on their guides when the drop side is locked in the lowered position.

BRIEF DESCRIPTION OF THE DRAWINGS

The above and other objects, features, and advantages of the invention will become more apparent from the following description of certain preferred embodiments thereof, when taken in conjunction with the accompanying drawings in which:

FIG. 1 is a perspective view of a crib in accordance with one preferred embodiment of the invention;

FIG. 2 is a cross-sectional view taken on line 2—2 of FIG. 1 through the guiding and locking assembly of the crib;

FIG. 4 is a magnified exploded view showing a lower guide and lower slide of the guiding and locking mechanism;

DETAILED DESCRIPTION OF THE INVENTION

Figures 3, 5, 6:
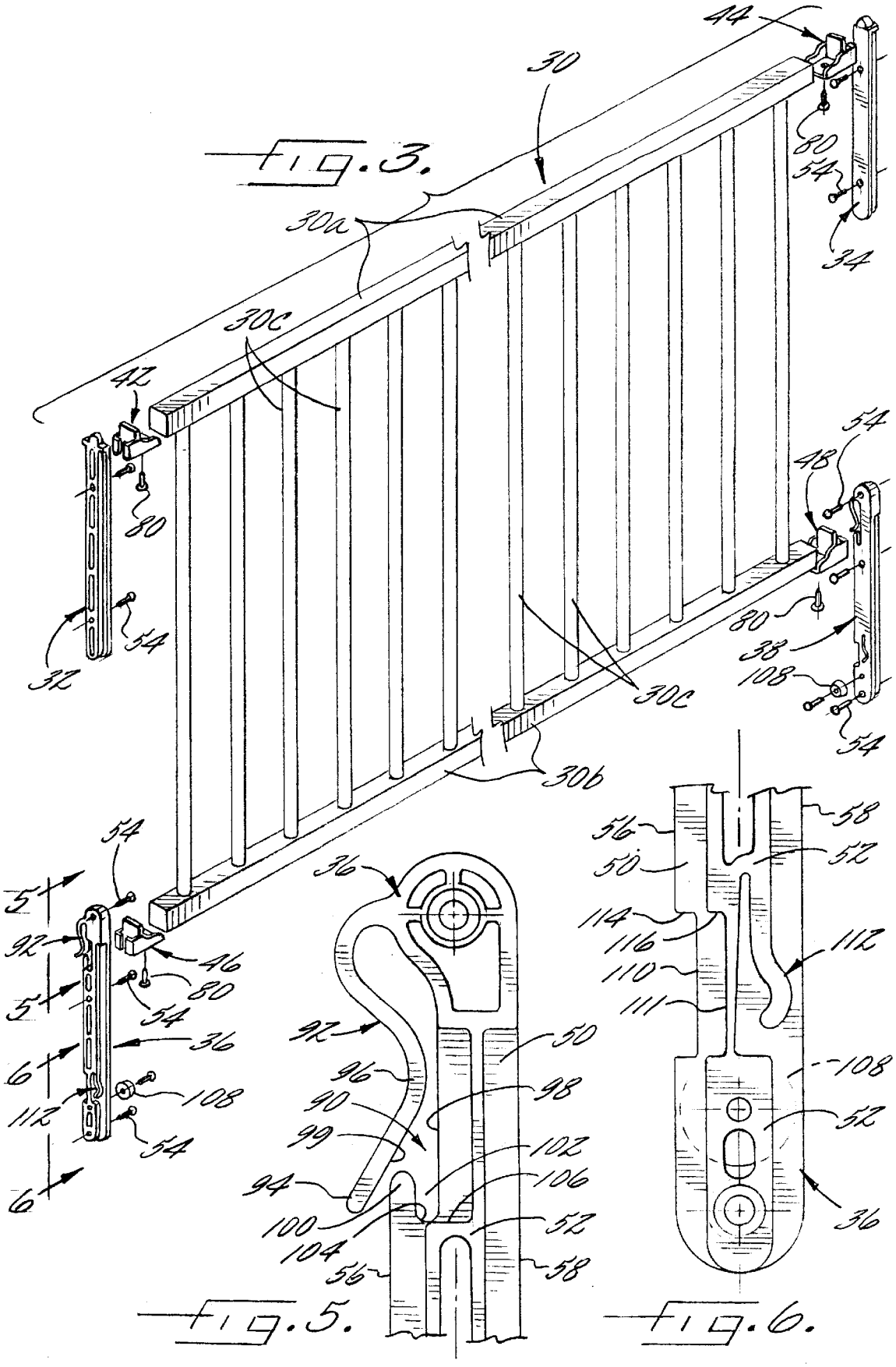
FIG. 3 is an exploded perspective view of the drop side and the guiding and locking mechanism of the crib.
FIG. 5 is a magnified view along the direction indicated by line 5—5 in FIG. 3, showing an upper end of a lower guide for the guiding and locking mechanism.
FIG. 6 is a magnified view along the direction indicated by line 6—6 in FIG. 3, showing a lower end of the lower guide for the guiding and locking mechanism.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to FIG. 1, a crib 10 in accordance with a preferred embodiment of the invention is shown. The crib includes a pair of vertical rear corner posts 12, 14 and a pair of vertical front corner posts 16, 18 arranged in a rectangular array. A rear panel 20 is attached at its opposite ends to the rear corner posts 12 and 14, one end panel 22 is attached at its opposite ends to the rear corner post 12 and the front corner post 16, and another end panel 24 is attached at its opposite ends to the rear corner post 14 and the front corner post 18. The crib also includes a drop side 30 that extends between the front corner posts 16 and 18 and includes an upper rail 30*a* and a lower rail 30*b* and a plurality of vertical members 30*c* extending therebetween.

With reference to FIGS. 1–4, the drop side 30 is vertically slidable up and down by virtue of a guiding and locking assembly including a pair of upper guides 32, 34 respectively affixed to the front corner posts 16, 18 near upper ends thereof, and a pair of lower guides 36, 38 affixed to the front corner posts 16, 18 near lower ends thereof. The guiding and locking assembly also includes a pair of upper slides 42, 44 affixed to opposite ends of the upper rail 30*a*, and a pair of lower slides 46, 48 affixed to opposite ends of the lower rail 30*b*. The upper slides 42, 44 slidably engage the upper guides 32, 34, respectively. Similarly, the lower slides 46, 48 slidably engage the lower guides 36, 38, respectively. Accordingly, the drop side 30 can be slid upward and downward and its motion is guided by the sliding engagement of the slides with the guides, as further described below.

FIG. 4 is an exploded view of the lower guide 36 and the lower slide 46, as viewed generally from a side of the guide 36 that abuts the front corner post 16. The other lower guide 38 is a mirror image of the guide 36, and hence the features described herein in connection with the guide 36 are also possessed by the guide 38 and are given the same reference numerals on the drawings. Furthermore, in the illustrated embodiment, all of the slides 42, 44, 46, 48 are identical, and thus the description of the lower slide 46 herein applies to the other slides as well. With primary reference to FIGS. 2, 4, and 7, the lower guide 36 comprises an elongate bar having a plate-shaped portion constituting a guide member 50 that guides the sliding motion of the lower slide 46. The lower guide also includes a stiffening and spacing portion 52 joined to the surface of the plate-shaped guide member 50 that faces the front corner post 16. The stiffening and spacing portion 52 abuts the front corner post 16 and the guide 36 is affixed to the front corner post by threaded fasteners 54. Thus, the guide member 50 of the lower guide is spaced from the front corner post by a distance corresponding to the thickness of the stiffening and spacing portion 52.

The opposite edges of the guide member 50 define parallel guide surfaces 56, 58. The guide surface 56 faces generally toward the rear panel 20 of the crib, and the opposite guide surface 58 faces generally away from the rear panel 20. The lower slide 46, as shown in FIG. 4, includes a generally C-shaped portion 60 defined by a vertical plate portion 62 and a pair of walls 64, 66 that are joined to the plate portion 62 perpendicular thereto and project horizontally from the opposite vertical side edges of the plate portion 62. The walls 64, 66 include fingers 68, 70, respectively, that are joined to the ends of the walls remote from the plate portion 62 and extend generally parallel to the plate portion 62. Thus, the plate portion 62, walls 64, 66, and fingers 68, 70 collectively define a channel 72. The channel 72 has length and width dimensions slightly larger than the width and thickness dimensions of the guide member 50 of the lower guide 36, and the channel 72 receives the guide member 50 therein; accordingly, the lower slide 46 can freely slide along the guide member 50.

The lower slide 46 also includes a shelf-like support portion 74 joined to an opposite side of the plate portion 62 from the walls 64, 66, at a lower edge of the plate portion 62, and projecting horizontally therefrom. A pair of upstanding side walls 76, 78 are joined to and project vertically upward from the opposite side edges of the support portion 74. The side walls 76, 78 are spaced apart a distance slightly greater than a horizontal thickness of the lower rail 30*b* of the drop side 30 of the crib. An end portion of the lower rail 30*b* is received between the side walls 76, 78 and rests upon the support portion 74. A threaded fastener 80 is passed through a hole 82 in the support portion and through a corresponding hole in the lower rail 30*b* and is screwed into the lower rail 30*b* to affix the lower slide 46 to the lower rail. The opposite end of the lower rail 30*b* is similarly affixed to the lower slide 48, which is slidably engaged with the lower guide 38, and likewise, the ends of the top rail 30*a* are affixed to the upper slides 42, 44, which are slidably engaged with the upper guides 32, 34, the upper guides having plate-shaped guide members engaged in the channels of the upper slides similar to the lower guides. Thus, the drop side 30 can be slid up and down by virtue of the sliding engagement between the slides and guides.

The lower guides 36, 38 include locking mechanisms for locking the drop side 30 in a raised position. More particularly, with reference to FIG. 5, the rear-facing guide surface 56 of the guide member 50 includes an upper recess 90 formed therein, recessed in the direction generally toward the front-facing guide surface 58. Opposite the recess 90, a resilient locking member 92 is affixed to the guide 36 such that it is supported in cantilever fashion by a fixed end of the locking member joined to a portion of the guide adjacent the upper end of the recess 90. The free end 94 of the locking member 92 is located generally opposite a lower end of the recess 90 and is spaced from the guide surface 56. The locking member 92 is arcuate such that a middle portion 96 of the locking member is bowed so as to extend into the recess 90 while being spaced from a vertical wall 98 of the recess. Between the middle portion 96 and the free end 94 of the locking member, the locking member defines a sloping wall 99 that slopes away from the vertical wall 98 of the recess in the downward direction. The guide includes a retaining portion 100 adjacent the lower end of the recess 90 so as to form a locking slot 102 between the retaining portion 100 and the vertical wall 98 of the recess. The locking slot 102 terminates at a bottom wall defining a lower stop 104 the purpose of which will become apparent below.

Figure 7:
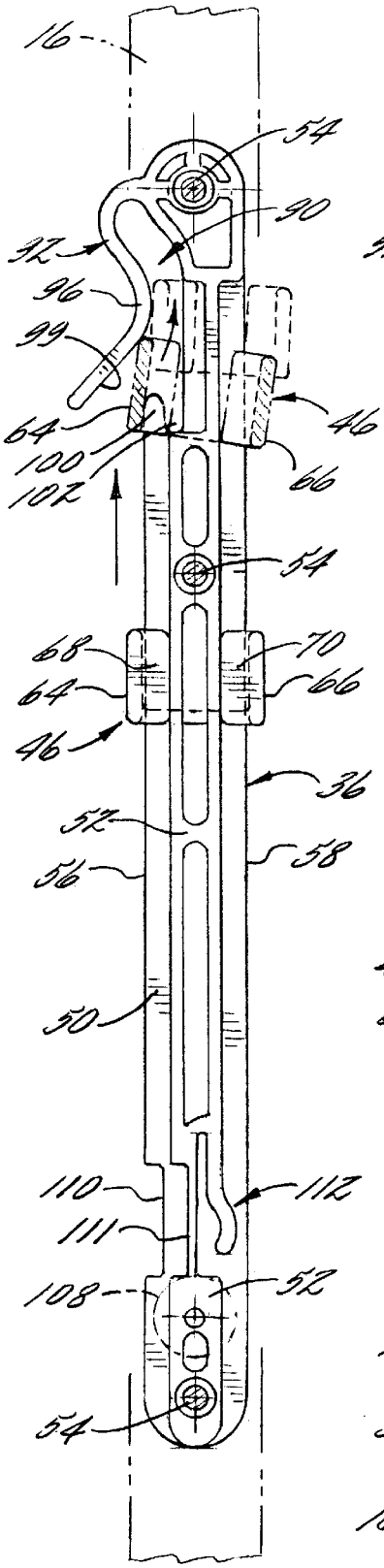
FIG. 7 is an elevation of the lower guide showing the lower slide engaged therewith and illustrating the lower slide being slid upward to engage and be deflected by the upper locking member into the upper recess.
Figure 7A:
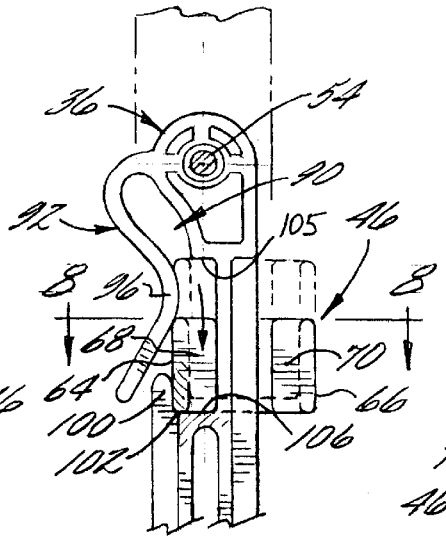
FIG. 7A is partial elevation similar to FIG. 7, showing the lower slide fully engaged in the upper recess of the lower guide in a locked position.
Figure 8:
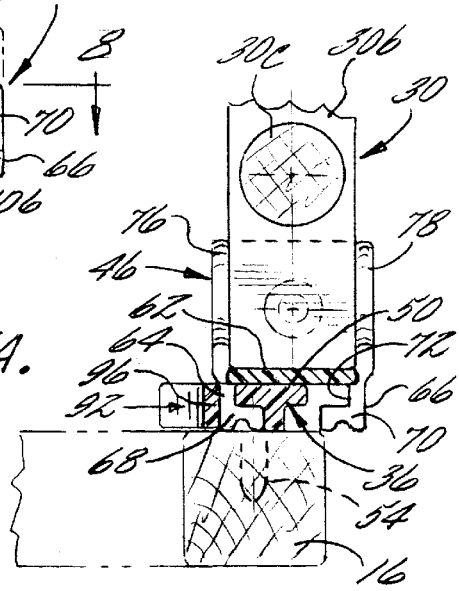
FIG. 8 is a cross-sectional view taken on line 8—8 of FIG. 7A.

As shown in FIG. 7, when the drop side of the crib is raised to an upper position in which it is desired to lock the drop side, the lower slide 46 is slid upward along the guide 36 and encounters the sloping wall 99 (FIG. 5) of the locking member 92. Further upward movement of the slide 46 causes the slide to be urged into the recess 90 by the locking member 92, which initially is deflected outward of the recess 90 as shown in FIG. 7 because of the interference between the locking member and the slide, but returns to its original undeflected position when the slide moves up above the retaining portion 100 of the guide as shown by the phantom-line rendering of the lower slide in FIG. 7A. The maximum upward movement of the drop side is limited by an upper stop 105 (FIG. 7A) formed at the upper end of the recess 90. The drop side of the crib is then allowed to fall downward slightly until the lower slide 46 abuts the lower stop 104 (FIG. 5) of the locking slot 102, as shown in solid lines in FIG. 7A. Preferably, the lower slide in this position also abuts an additional lower stop 106 defined by an upward-facing surface of the stiffening and spacing portion 52 of the guide 36. The same thing occurs between the other lower slide 48 and its associated lower guide 38. Accordingly, the drop side is locked in the raised position.

To lower the drop side, it is raised slightly so that the lower slides are raised above the retaining portions 100 of the lower guides as in FIG. 7, and the drop side is urged horizontally in a direction generally normal to the drop side and toward the rear panel 20 of the crib (i.e., to the left in FIG. 7) so that the lower slides are urged against the locking members 92. The locking members 92 are thus deflected outward from the recesses 90 of the lower guides, allowing the lower slides to exit the recesses. The drop side can then be dropped down to a lowered position. Each lower guide 36, 38 includes a lower bumper 108 affixed to the guide near a lower end thereof for limiting the downward movement of the drop side.

Figure 9:
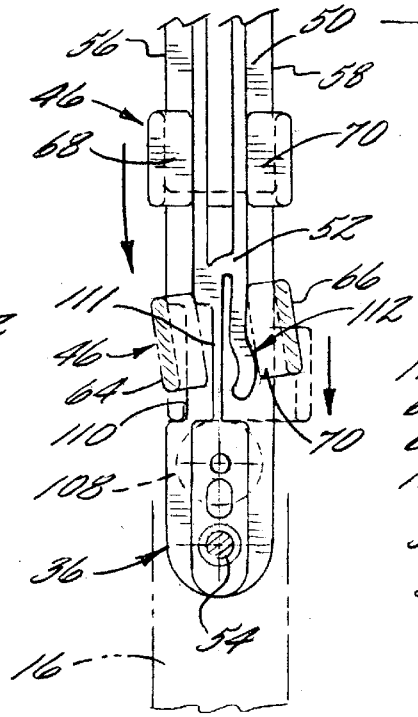
FIG. 9 is a partial elevation of the lower end of the lower guide with the lower slide engaged therewith, and illustrating the lower slide being slid down, to engage and be deflected by the lower locking member into the lower recess.
Figure 9A:
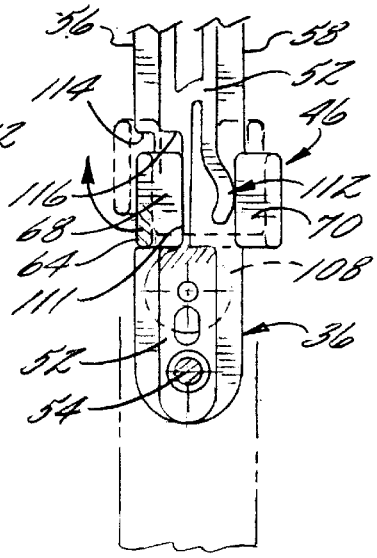
FIG. 9A is a view similar to FIG. 9, showing the lower slide fully engaged in the lower recess in a locked position.

The lower guides 36, 38 preferably also include a locking and anti-rattle mechanism for locking the drop side in the lowered position and for preventing or reducing rattling between the lower slides 46, 48 and the lower guides 36, 38. More particularly, with reference to FIGS. 6, 9, and 9A, each lower guide includes a lower recess 110 formed in the rear-facing guide surface 58 of the guide member 50 and located in the vertical direction such that the recess 110 is aligned with the lower slide 46 or 48 when the slide is resting upon the corresponding bumper 108. The guide also includes a resilient lower locking member 112 joined to the stiffening and spacing portion 52 of the guide and positioned such that when the lower slide is slid down to the recess 110 the locking member 112 contacts the front finger 70 of the lower slide and causes the lower slide to be deflected forwardly such that the rear wall 64 of the slide is forced into the recess 110, as shown in phantom lines in FIG. 9A. The slide is thus prevented from being slid back upward on the guide because of interference between the rear wall 64 and an upper stop 114 at the upper end of the recess 110. Preferably, the stiffening and spacing portion 52 of the guide also defines an additional stop surface 116 for the lower slide to prevent upward movement thereof. Thus, when the lower slides are engaged in the recesses 110 of the lower guides, the drop side of the crib is locked in the lowered position. Furthermore, preferably the locking members 112 are formed so as to apply a continuous biasing force (to the right in FIG. 9A) on the lower slides urging the slides against the vertical walls 111 of the recesses as shown in solid lines in FIG. 9A, thus reducing or preventing rattling of the slides on the guides.

To raise the drop side, the drop side is urged rearwardly toward the rear panel 20 of the crib so that the lower slides 46, 48 press against and deflect the locking members 112 rearwardly (i.e., to the left in FIG. 9A), thus allowing the lower slides to clear the stop surfaces 114, 116 so that the drop side can be raised.

Preferably, the lower guides 46, 48 with their associated locking members 92, 112 and stiffening and spacing portion 52 comprise integral one-piece structures. For instance, advantageously, the lower guides can be molded of plastic that is resiliently flexible.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A crib, comprising:

a rear panel connected between a pair of vertical rear corner posts, a front panel comprising a drop side connected between a pair of vertical front corner posts, and a pair of end panels connected between the front and rear corner posts to form a rectangular structure;

at least one guide affixed to each of the front corner posts adjacent opposite ends of the drop side, each guide defining a vertically extending guide track; and a pair of slides affixed to opposite ends of the drop side and respectively in sliding engagement with the guide tracks of the guides, whereby the drop side is vertically slidable along the guides between raised and lowered positions;

wherein the guide track of each guide is formed by a pair of vertically extending, spaced guide surfaces respectively facing generally toward and away from the rear panel, one of the guide surfaces having an upper recess that is recessed into said guide surface in a horizontal direction, and each of the guides defining a stop surface facing generally upwardly and located adjacent a lower end of the upper recess, each guide further comprising a resilient upper locking member affixed thereto opposite the upper recess and arranged to contact and urge the corresponding slide into the upper recess when the drop side is slid upward to the raised position such that the drop side is prevented by the stop surface from sliding back down to the lowered position, the slide being disengageable from the upper recess by urging the drop side in a direction generally normal thereto so as to urge the slide against the upper locking member to deflect the upper-locking member until the slide clears the stop surface such that the drop side can be dropped to the lowered position.

2. The crib of claim 1, wherein each front corner post has an upper guide and a lower guide affixed thereto, and the drop side includes an upper slide and a lower slide affixed at each end of the drop side and in sliding engagement with the upper and lower guides, and wherein each lower guide includes the recess for locking the drop side in the raised position.

3. The crib of claim 2, wherein a retaining portion of each lower guide projects upward from adjacent the lower end of the upper recess and forms a slot between the retaining portion and an opposing portion of the lower guide such that the lower slides cannot be disengaged from the upper recesses until the lower slides are lifted over the retaining portions, whereby the drop side must be both lifted and urged in the direction generally normal to the drop side in order to be dropped to the lowered position.

4. The crib of claim 2, wherein each lower guide and corresponding upper locking member are integrally formed together as a one-piece structure.

5. The crib of claim 2, each lower guide further comprising a lower recess in one of the guide surfaces and spaced below the upper recess, and a resilient lower locking member affixed to the lower guide for urging the lower slide into the lower recess when the drop side is dropped to the lowered position, each lower guide defining a downward-facing stop surface adjacent an upper end of the lower recess for preventing the lower slide from being slid back up along the guide track as long as the lower slide is in the lower recess, whereby the drop side is locked in the lowered position.

6. The crib of claim 5, wherein each lower guide and the upper and lower locking members thereof are integrally formed together as a one-piece structure.

7. The crib of claim 5, wherein the lower locking member of each lower guide is structured and arranged to apply a continuous biasing force on the corresponding lower slide when disposed in the lower recess, so as to substantially reduce rattling of the lower slides when the drop side is locked in the lowered position.

8. A guiding and locking mechanism for a drop side of a crib, comprising:

a guide configured to be affixed to a vertical corner post of the crib, the guide defining a vertically extending guide track formed by a pair of vertically extending, spaced guide surfaces respectively facing generally inwardly and generally outwardly with respect to a horizontal direction, one of the guide surfaces having an upper recess that is recessed into the guide surface in the horizontal direction, and the guide defining a stop surface facing generally upwardly and located adjacent a lower end of the upper recess;

a slide in sliding engagement with the guide track and configured to be affixed to the drop side of the crib, the slide being structured and arranged such that a portion of the slide is free to move into the upper recess in the one guide surface when the slide is slid upward to the upper recess such that the portion of the slide is above the stop surface of the guide; and a resilient upper locking member affixed to the guide opposite the upper recess and arranged to contact and urge the slide into the upper recess such that the slide is prevented by the stop surface from sliding back down along the guide track, the slide being disengageable from the upper recess by urging the slide against the upper locking member to deflect the upper locking member until the slide clears the stop surface such that the slide can be slid back down along the guide track.

9. The guiding and locking mechanism of claim 8, wherein the guide and upper locking member are integrally formed together as a one-piece structure.

10. The guiding and locking mechanism of claim 9, wherein the guide comprises a guide member having opposite side edges defining the guide surfaces of the guide track, and the slide defines a channel into which the guide member is slidably received.

11. The guiding and locking mechanism of claim 8, wherein the guide has a generally T-shaped cross-section normal to a longitudinal axis thereof, a wider portion of the T-shaped cross-section forming a guide member having opposite edges that define the guide surfaces, and a narrower portion of the T-shaped cross-section being arranged to abut the corner post of the crib so as to space the guide member away from the corner post.

12. The guiding and locking mechanism of claim 8, wherein the upper locking member is arcuate having a lower portion spaced relatively farther from the recess of the guide surface and a middle portion spaced relatively closer to the recess.

13. The guiding and locking mechanism of claim 12, wherein the middle portion of the upper locking member, in an undeflected position thereof, projects into the recess.

14. The guiding and locking mechanism of claim 8, wherein a retaining portion of the guide projects upward from adjacent the lower end of the upper recess and forms a slot between the retaining portion and an opposing portion of the guide such that the slide cannot be disengaged from the upper recess until the slide is lifted over the retaining portion.

15. The guiding and locking mechanism of claim 8, the guide further comprising a lower recess in one of the guide surfaces and spaced below the upper recess, and a resilient lower locking member affixed to the guide for urging the slide into the lower recess, the guide defining a downward-facing stop surface adjacent an upper end of the lower recess for preventing the slide from being slid back up along the guide track as long as the slide is in the lower recess.

16. The guiding and locking mechanism of claim 15, wherein the guide and the upper and lower locking members are integrally formed together as a one-piece structure.

17. The guiding and locking mechanism of claim 15, wherein the lower locking member is structured and arranged to apply a continuous biasing force on the slide when disposed in the lower recess so as to substantially reduce rattling of the slide in the horizontal direction.

18. The guiding and locking mechanism of claim 15, wherein the guide comprises a guide member having opposite side edges defining the guide surfaces of the guide track, and the slide defines a channel into which the guide member is slidably received between opposing surfaces of the channel, and wherein the lower locking member is disposed generally between the opposing surfaces of the channel in the slide.

19. The guiding and locking mechanism of claim 18, wherein the guide member is generally plate-shaped, and the guide includes a spacer joined to and extending lengthwise along one surface of the guide member for spacing the guide member from the corner post of the crib, the lower locking member being affixed to the spacer.

20. The guiding and locking mechanism of claim 19, wherein the guide member, spacer, and lower locking member are integrally formed together as a one-piece structure.

21. The guiding and locking mechanism of claim 19, wherein the slide includes a pair of opposed fingers that extend from the opposing surfaces of the channel toward each other to capture the guide member in the channel, and wherein the lower locking member contacts one of the fingers when the slide is slid down to the lower end of the guide so as to urge the slide into the lower recess.

22. The guiding and locking mechanism of claim 21, wherein the other of the fingers and the downward-facing stop surface of the guide cooperate to prevent upward movement of the slide as long as the slide is in the lower recess.

23. A guiding and locking mechanism for a drop side of a crib, comprising:

a guide configured to be affixed to a vertical corner post of the crib, the guide defining a vertically extending guide track formed by a pair of vertically extending, spaced guide surfaces respectively facing generally inwardly and generally outwardly with respect to a horizontal direction, one of the guide surfaces having an upper recess that is recessed into the guide surface in the horizontal direction, one of the guide surfaces having a lower recess that is recessed into the guide surface in the horizontal direction and spaced below the upper recess, and the guide defining an upper stop surface located adjacent a lower end of the upper recess and a lower stop surface located adjacent an upper end of the lower recess;

a slide in sliding engagement with the guide track and configured to be affixed to the drop side of the crib, the slide being structured and arranged such that a portion of the slide is free to move into the upper recess when the slide is slid upward to the upper recess such that the portion of the slide is above the upper stop surface of the guide, and the slide being arranged such that a portion of the slide is free to move into the lower recess when the slide is slid downward to the lower recess such that the portion of the slide is below the lower stop surface of the guide; and a resilient upper locking member affixed to the guide opposite the upper recess and arranged to contact and urge the slide into the upper recess such that the slide is prevented by the upper stop surface from sliding back down along the guide track, and a resilient lower locking member affixed to the guide and arranged to contact and urge the slide into the lower recess such that the slide is prevented by the lower stop surface from sliding back up the guide, the slide being disengageable from each recess by urging the slide against the corresponding locking member to deflect said locking member until the slide clears the corresponding stop surface such that the slide can be slid along the guide track.

24. The guiding and locking mechanism of claim 23, wherein the guide and the upper and lower locking members are integrally formed together as a one-piece structure.

25. A guiding and locking assembly for a drop side of a crib, comprising:

a pair of guides configured to be affixed to a pair of spaced corner posts adjacent opposite ends of the drop side; and a slide in sliding engagement with the guide track of each guide and configured to be affixed to an adjacent end of the drop side;

wherein the guide track of each guide is formed by a pair of vertically extending, spaced guide surfaces respectively facing generally inwardly and generally outwardly with respect to a horizontal direction, one of the guide surfaces having an upper recess that is recessed in the horizontal direction, and the guide defining a stop surface facing generally upwardly and located adjacent a lower end of the upper recess, each guide further comprising a resilient upper locking member affixed to the guide opposite the upper recess and arranged to contact and urge the slide into the upper recess such that the slide is prevented by the stop surface from sliding back down along the guide track, the slide being disengageable from the upper recess by urging the slide against the upper locking member to deflect the upper locking member until the slide clears the stop surface such that the slide can be slid back down along the guide track.

26. The guiding and locking assembly of claim 25, wherein each guide and corresponding upper locking member are integrally formed together as a one-piece structure.

27. The guiding and locking assembly of claim 25, wherein each guide has a generally T-shaped cross-section normal to a longitudinal axis thereof, a wider portion of the T-shaped cross-section forming a guide member having opposite edges that define the guide surfaces, and a narrower portion of the T-shaped cross-section being arranged to abut the corner post of the crib so as to space the guide member away from the corner post.

28. The guiding and locking assembly of claim 25, wherein a retaining portion of each guide projects upward from adjacent the lower end of the upper recess and forms a slot between the retaining portion and an opposing portion of the guide such that the slide cannot be disengaged from the upper recess until the slide is lifted over the retaining portion.

29. The guiding and locking assembly of claim 25, each guide further comprising a lower recess in one of the guide surfaces proximate a lower end of the guide, and a resilient lower locking member affixed to the guide for urging the slide into the lower recess, the guide defining a downward-facing stop surface adjacent an upper end of the lower recess for preventing the slide from being slid back up along the guide track as long as the slide is in the lower recess.

30. The guiding and locking assembly of claim 29, wherein each guide and the upper and lower locking members thereof are integrally formed together as a one-piece structure.

31. The guiding and locking assembly of claim 29, wherein the lower locking member of each guide is structured and arranged to apply a continuous biasing force on the corresponding slide when disposed in the lower recess so as to substantially reduce rattling of the slide on the guide in the horizontal direction.

* * * * *